US009930975B2

(12) United States Patent
Röhrig

(10) Patent No.: US 9,930,975 B2
(45) Date of Patent: Apr. 3, 2018

(54) SUSPENSION APPARATUS

(71) Applicant: MAM BABYARTIKEL GESELLSCHAFT M.B.H., Vienna (AT)

(72) Inventor: Peter Röhrig, Vienna (AT)

(73) Assignee: MAM BABYARTIKEL GESELLSCHAFT M.B.H., Vienna (AT)

( * ) Notice: Subject to any disclaimer, the term of this patent is extended or adjusted under 35 U.S.C. 154(b) by 0 days.

(21) Appl. No.: 14/417,652

(22) PCT Filed: Jul. 22, 2013

(86) PCT No.: PCT/AT2013/050140

§ 371 (c)(1),
(2) Date: Jan. 27, 2015

(87) PCT Pub. No.: WO2014/019005

PCT Pub. Date: Feb. 6, 2014

(65) Prior Publication Data

US 2015/0196141 A1 Jul. 16, 2015

(30) Foreign Application Priority Data

Jul. 31, 2012 (AT) ..... A 50306/2012

(51) Int. Cl.
*A47F 5/00* (2006.01)
*B65D 73/00* (2006.01)
(Continued)

(52) U.S. Cl.
CPC ..... *A47F 5/0006* (2013.01); *A47F 7/28* (2013.01); *B65D 73/0085* (2013.01); *G09F 1/06* (2013.01);
(Continued)

(58) Field of Classification Search
CPC ..... B65D 73/008; G09F 3/02; G09F 23/06; G09F 1/06; G09F 23/00; A47F 5/0006; A47F 7/28
(Continued)

(56) References Cited

U.S. PATENT DOCUMENTS 1,910,168 A * 5/1933 Jacobs ..... A45F 5/10 206/446
2,248,234 A * 7/1941 Hickman ..... A47J 45/10 294/137
(Continued)

FOREIGN PATENT DOCUMENTS

CN 101115663 A 1/2008
EP 1 136 971 A2 9/2001
(Continued)

OTHER PUBLICATIONS

Austrian Office Action 2013 No. 1AA 50306/2012 1 Vienna, dated Jun. 2013, to IPC: B65D Goggle Translation.
(Continued)

*Primary Examiner* — Muhammad Ijaz
(74) *Attorney, Agent, or Firm* — Ladas & Parry LLP

(57) ABSTRACT

Suspension apparatus (1) for a sales item (2), in particular for a drinking bottle (2'), having a suspension opening (4) for suspending the suspension apparatus (1), having a base part (5) which has a holding opening (6) for carrying the sales item (2), and having side parts (8) which, together with the base part (5), form a recess (11) for receiving a portion of the sales item (2), which portion projects through the holding opening (6), wherein an insert part (13) for displaying product and sales information is arranged in the recess (11) such that it can be exchanged.

16 Claims, 5 Drawing Sheets

(51) Int. Cl.

| | |
|---|---|
| ***G09F 23/00*** | (2006.01) |
| ***G09F 23/06*** | (2006.01) |
| ***G09F 1/06*** | (2006.01) |
| ***A47F 7/28*** | (2006.01) |
| ***G09F 3/02*** | (2006.01) |
| *B65D 23/00* | (2006.01) |
| *B65D 23/14* | (2006.01) |

(52) U.S. Cl.
CPC ..... *G09F 3/02* (2013.01); *G09F 23/00* (2013.01); *G09F 23/06* (2013.01); *B65D 23/005* (2013.01); *B65D 23/14* (2013.01); *B65D 2203/00* (2013.01)

(58) Field of Classification Search
USPC ..... 248/318, 152, 224.8, 317; 206/486, 488, 206/775, 780, 461
See application file for complete search history.

(56) References Cited

U.S. PATENT DOCUMENTS

| | | | | | |
|---|---|---|---|---|---|
| 2,790,587 | A * | 4/1957 | Contant | B65D 11/12 | 206/232 |
| 3,519,244 | A * | 7/1970 | Lidgard | B65D 85/48 | 206/448 |
| 4,625,441 | A * | 12/1986 | Fast | G09F 3/20 | 40/649 |
| 4,706,804 | A * | 11/1987 | Hall | B65D 71/44 | 206/148 |
| 5,667,070 | A * | 9/1997 | Miret | B65D 71/48 | 206/153 |
| 5,961,043 | A * | 10/1999 | Samuelson | A01M 1/2044 | 206/486 |
| 6,059,101 | A * | 5/2000 | Gambardella | G09F 1/06 | 206/308.1 |
| 6,196,387 | B1 * | 3/2001 | Hsi-Chang | B65D 73/0078 | 206/349 |
| 6,298,992 | B1 * | 10/2001 | Tsao | B65D 71/48 | 206/194 |
| 6,877,263 | B2 * | 4/2005 | Clark | B42D 15/045 | 206/308.1 |
| 7,311,205 | B2 * | 12/2007 | Adler | B65D 1/0223 | 206/459.5 |
| 8,083,126 | B2 * | 12/2011 | Fleming | B65D 71/30 | 206/194 |
| 8,091,702 | B1 * | 1/2012 | Keip | A47G 23/0208 | 206/171 |
| 2005/0087464 | A1 * | 4/2005 | Brattesani | B65D 75/54 | 206/361 |
| 2005/0224390 | A1 * | 10/2005 | Auclair | B65D 5/5045 | 206/588 |
| 2006/0124495 | A1 * | 6/2006 | David | B65D 73/0085 | 206/461 |
| 2008/0023352 | A1 * | 1/2008 | Creed | B65D 73/0078 | 206/232 |
| 2009/0184023 | A1 * | 7/2009 | Brollier | A61J 1/035 | 206/531 |
| 2012/0153109 | A1 * | 6/2012 | Milbrandt | B65D 23/005 | 248/224.8 |

FOREIGN PATENT DOCUMENTS

| | | | |
|---|---|---|---|
| FR | 2655021 | A1 | 5/1991 |
| JP | 2003-341718 | A | 12/2003 |
| WO | 2006/060857 | A1 | 6/2006 |
| WO | 2011020084 | A1 | 2/2011 |

OTHER PUBLICATIONS

International Search Report dated Nov. 19, 2013; PCT/AT2013/050140.
Written Opinion of the International Searching Authority dated Feb. 3, 2015; PCT/AT2013/050140.
Taiwan Search Report dated May 27, 2015; Application No. 1021277262.
Taiwan Office Action dated Jun. 2, 2015; Appln. No. 102127262.

* cited by examiner

SUSPENSION APPARATUS

The invention relates to a suspension apparatus for a sales item, in particular for a drinks bottle, comprising a suspension opening for suspending the suspension apparatus, comprising a base portion which has a retaining opening for carrying the sales item and comprising side portions which with the base portion enclose a recess for receiving a portion of the sales item projecting through the retaining opening.

Such suspension apparatuses, frequently also designated as hanging cards, are known in various designs and enable a clearly visible arrangement of sales items in self-service shops. For this purpose a plurality of suspension apparatuses can be suspended on a rod-like holder and removed from there.

Known on the one hand are hanging cards made of a paper material which can be printed in a simple manner with details of goods. Disadvantageously however, these hanging cards are not very resistant and barely suitable for holding heavier sales items. In addition, it is disadvantageous that the production of the hanging cards must be adapted when changes in the details of goods are to be taken into account. Finally it is disadvantageous that only a little information can be accommodated on the printed hanging cards.

On the other hand, hanging cards made of plastic are known in the prior art, which are distinguished by a higher load-bearing capacity. However, the printing of plastic hanging cards with details of goods is disadvantageously expensive. Furthermore, a hanger made of polypropylene was disclosed in FR 2 655 021 which is inscribed by means of one or more self-adhesive labels. However, the labels disadvantageously offer little space for goods information. Furthermore, it is disadvantageous that when removing the labels, adhesive residues can arise. Accordingly, in many cases it is frequently necessary to replace the hanger when the information on the label is to be changed.

Already known from U.S. Pat. No. 4,706,804 A is a suspension apparatus having a flat main portion formed by the parallel adjacent surfaces and a carrier portion which is disposed at right angles on the main portion. Disadvantageously however no manifold product and sales information can be displayed in a variable manner with such a suspension apparatus.

Known from U.S. Pat. No. 1,910,168 A1 is a cup carrier made of paper or cardboard having a central portion which forms the base of the carrier and having side portions which are connected to the middle portion via the intermediate portions and which enclose a triangular opening in which a cup is held. In this cup carrier however, no manifold product and sales information can be displayed in a variable manner.

U.S. Pat. No. 2,248,234 discloses a folded carrying apparatus for milk bottles which also consists of an opaque piece of cardboard. In a flat central portion the card has a substantially elliptical opening for receiving a bottle neck.

Further known from EP 1 136 971 A2 is a hanging sign having an opening for connection to an elongated article. In this case, a part of the article projecting through the opening remains freely accessible. An expanded content device is accommodated in the hanging sign or connected to its side portion by means of adhesive connection. Therefore no manifold product and sales information can be displayed in a variable manner with this hanging sign.

A different type of packaging apparatus is known, for example, from JP 2003-341718 A. Disclosed therein is a packaging carton for a plurality of beverage cans which is provided with a cover plate having carrying openings, having side portions and having a base plate, which enclose the beverage cans so that only the outer cans are visible and accessible at the short ends of the packaging. In this different type of packaging, an advertising sign can be inserted between the cover plate and the upper side of the cans and fastened in the packaging.

Finally known from WO 2011/020084 A1 is a suspension apparatus having side portions, which each have an opening for suspending on a hook. The side portions are adjoined by an opening plate having a retaining opening in which a part of a bottle can be inserted. Only the outer sides of the side portions are provided for displaying information relating to a bottle so that here also restricted space for product and sales information is available.

Consequently it is the object of the present invention to provide a resistant suspension apparatus of the type mentioned initially with which manifold product and sales information can be displayed in a variable manner with constructively simple means.

According to the invention, an insert for displaying product or sales information is disposed exchangeably in the recess.

As a result of the loose or detachable arrangement of the insert inside the recess, diverse inserts can be disposed in a simple manner in the suspension apparatus according to the invention. This is particularly advantageous for an international sale of the same article since in such a case the product or sales information must be reproduced in various languages. Accordingly, it is possible with the suspension apparatus according to the invention to accommodate in a simple and cost-effective manner inserts in different languages in respectively one suspension apparatus which is otherwise configured to be the same, whereby appreciable savings can be achieved. In addition, the insert can advantageously be exchanged if required if the product or sales information has changed or the same suspension apparatus is used for different types of sales items. In this case, the holding of the insert in the recess is accomplished in particular in a frictionally engaged or form-fitting manner. Other than in the prior art, in which the suspension card itself is provided with an imprint or a stick-on label, the remaining components of the suspension apparatus can be used for different purposes so that a particularly variable design which can be used for different sales items is provided. In addition, simplifications and savings can be achieved in the production of the suspension apparatus. Advantageously, the insert does not additionally have to have a carrying function so that comparatively few requirements with regard to strength and durability can be imposed on the insert. In addition, the insert can be optimised for the display of the information which can relate, for example, to the type and model of the sales product, usage instructions etc. Consequently particularly comprehensive product or sales information can be reproduced via the insert. In addition, the material of the insert can be selected with a view to a visually attractive display of the information.

For the display of product or sales information of different types or in different languages it is favourable if a sheet printed with the product or sales information, in particular a folded sheet, preferably made of a paper material, is provided as insert. Thus, an inexpensive insert is provided which can be removed if necessary and possibly replaced by another insert. When using a paper material for the insert, a particularly simple printing technique can advantageously be used. The folded sheet is particularly suitable for displaying comprehensive product or sales information.

If the insert rests at least in sections against the inner side of one of the side portions, a frictional bond is produced between the contact surfaces whereby a slip-resistant effect is advantageously achieved. An unintentional slipping of the insert from its intended position can thus at least be made difficult. On the other hand, the contact surfaces between the insert and the side portion are free from adhesive layers so that no residues remain when removing the insert.

Preferably the insert extends over substantially the entire height and/or over substantially the entire width of at least one of the side portions. A particularly large area can herewith be provided for displaying the product or sales information. In this case, it is additionally advantageous if the insert in the prescribed position rests against the appurtenant side portion over substantially the entire width and/or over substantially the entire height, with the result that the slip-inhibiting frictional engagement between the contact surfaces is strengthened.

According to a preferred embodiment, the side portions are arranged inclined with respect to one another starting from an abutting edge. The side portions can in this case protrude at an angle from opposite side edges of the base portion which in the suspended state of the suspension apparatus is disposed substantially horizontally. Preferably the side portions and the base portion (in a horizontal arrangement) form a prism with a substantially isosceles triangle as base surface.

In order to secure the insert inside the recess, it is favourable if the insert rests at least in sections against the abutting edge between the side portions. Advantageously the outer edge of the insert is aligned along the abutting edge so that the insert is held in the prescribed position. Preferably separate longitudinal edges of the side portions abut against the abutting edge in particular at an acute angle with respect to one another. However, the side portions can also be joined to one another in one piece at the abutting edge.

In order to secure the insert against undesired release from the recess, it is advantageous if the insert is fixed in the prescribed position between the part of the sales item projecting through the retaining opening and at least one of the side portions. Consequently the insert in the prescribed position is clamped between the sales item and the side portion.

With a view to inexpensive manufacture of the suspension apparatus, it is advantageous if the base portion and the side portions are formed by a preferably one-part blank of a foldable material which is folded along fold lines. In the manufacture a blank is produced from an originally flat material sheet which is formed into the finished suspension apparatus by folding. The blank is preferably designed as a stamped part in this case. Consequently, the suspension apparatus can advantageously be produced in a particularly simple and cost-effective manner from a material sheet.

In order to achieve a particularly durable design, it is advantageous if a plastic film, preferably made of polypropylene, is provided as foldable material. The plastic film advantageously withstands high stresses so that damage to the suspension apparatus can be reliably avoided. If the plastic film is transparent, the product or sales information can be observed through the suspension apparatus.

In order to fix the insert in the prescribed position within the recess, it is additionally advantageous if the insert has a fastener opening for passage of a fastener portion. The insert can be connected detachably to the fastener portion via the fastener opening. In the connected state the insert and the fastener portion are connected positively to one another. Advantageously the insert can herewith be reliably secured against any unintentional release from the recess independently of the position of the suspension apparatus, for example, even in an upside-down position. The fastener portion is preferably part of the suspension apparatus; the fastener opening of the insert can however less preferably also be provided with an external fastening means which is fixed to the suspension apparatus.

If the fastener opening of the insert runs along a fold line of the insert, advantageously only a slight intervention in the insert is required to form the fastener opening. The appearance of the insert is herewith advantageously barely disturbed. In addition, at the fold edge the fastener opening does not use any space required for the display of information. In addition, the formation of the fastener opening on the fold line is particularly simple to manufacture. Preferably the fold line runs between two sheets of an insert formed as a folded sheet.

For holding the insert on the suspension apparatus, it is advantageous if a receiving opening is provided for an end region of the fastener portion guided through the fastener opening of the insert. In order to fix the insert in the prescribed position, the free end region of the fastener portion is guided through the fastener opening of the insert and fixed in the receiving opening. The receiving opening preferably extends on a hanging portion having the suspension opening. According to a less preferred embodiment, the receiving opening is dispensed with, the free end region of the fastener portion being fixed frictionally at an opening edge of the insert delimiting the fastener opening. The receiving opening is preferably configured as an incision which is shaped according to the end region of the fastener portion.

According to a particularly preferred embodiment, a tab portion which can be pivoted from the principal plane of the side portion is provided on one of the side portions.

In order to provide sufficient space for the arrangement of the sales item, it is favourable if a recess for exposing the portion of the sales item projecting through the retaining opening is formed on the side portion in the pivoted position of the tab portion. The tab portion can be transferred between a position lying in the principal plane of the side portion which blocks the recess and a position pivoted with respect to this, which exposes the recess. In the pivoted position of the tab portion, the part of the sales item projecting through the retaining opening can be guided outwards through the recess. Advantageously the internal volume of the suspension apparatus can herewith be kept small with the result that on the one hand, savings of material can be achieved and on the other hand, a space-saving arrangement of several suspension apparatuses one after the other is made possible.

In order to fix the insert detachably with simple means to the suspension apparatus, it is advantageous if the tab portion is configured as a fastener portion for connection to the fastener opening. For fixing the insert in the prescribed position it is therefore merely necessary to bring the tab portion into the pivoted position, where the tab portion is guided through the fastener opening of the insert. Preferably the free end region of the tab portion is additionally fixed in the receiving opening.

For production technology reasons it is preferred if the tab portion is formed by a cut edge from the side portion. Accordingly the tab portion is formed in one part with the side portion. In production the tab portion is cut free from the side portion.

For holding a bottle neck of the drinks bottle, it is favourable if the retaining opening is substantially circular. In use the drinks bottle is preferably fastened positively to the retaining opening. If the drinks bottle has an external thread, the drinks bottle can be screwed by means of the external thread into the retaining opening. Naturally however, it would also be feasible for the sales items to be fixed in the retaining opening by stretching the sections of the base part adjoining the retaining opening.

The invention is explained in further detail hereinafter with reference to a preferred exemplary embodiment shown in the drawings, to which it is not restricted however. In detail in the drawings.

Figure 1:
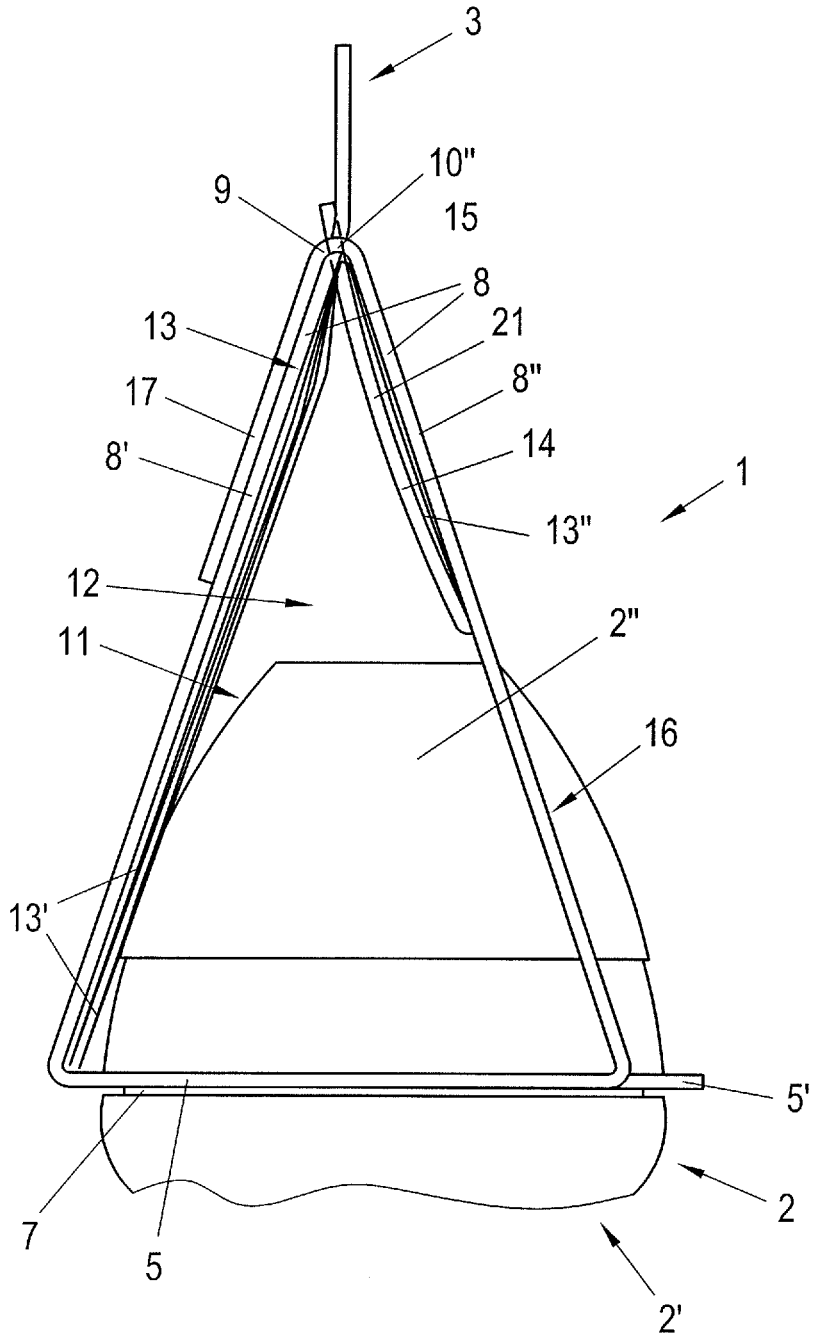
FIG. 1 shows a schematic view of a suspension apparatus according to the invention for a drinks bottle having an insert for display of product or sales information.
Figure 2:
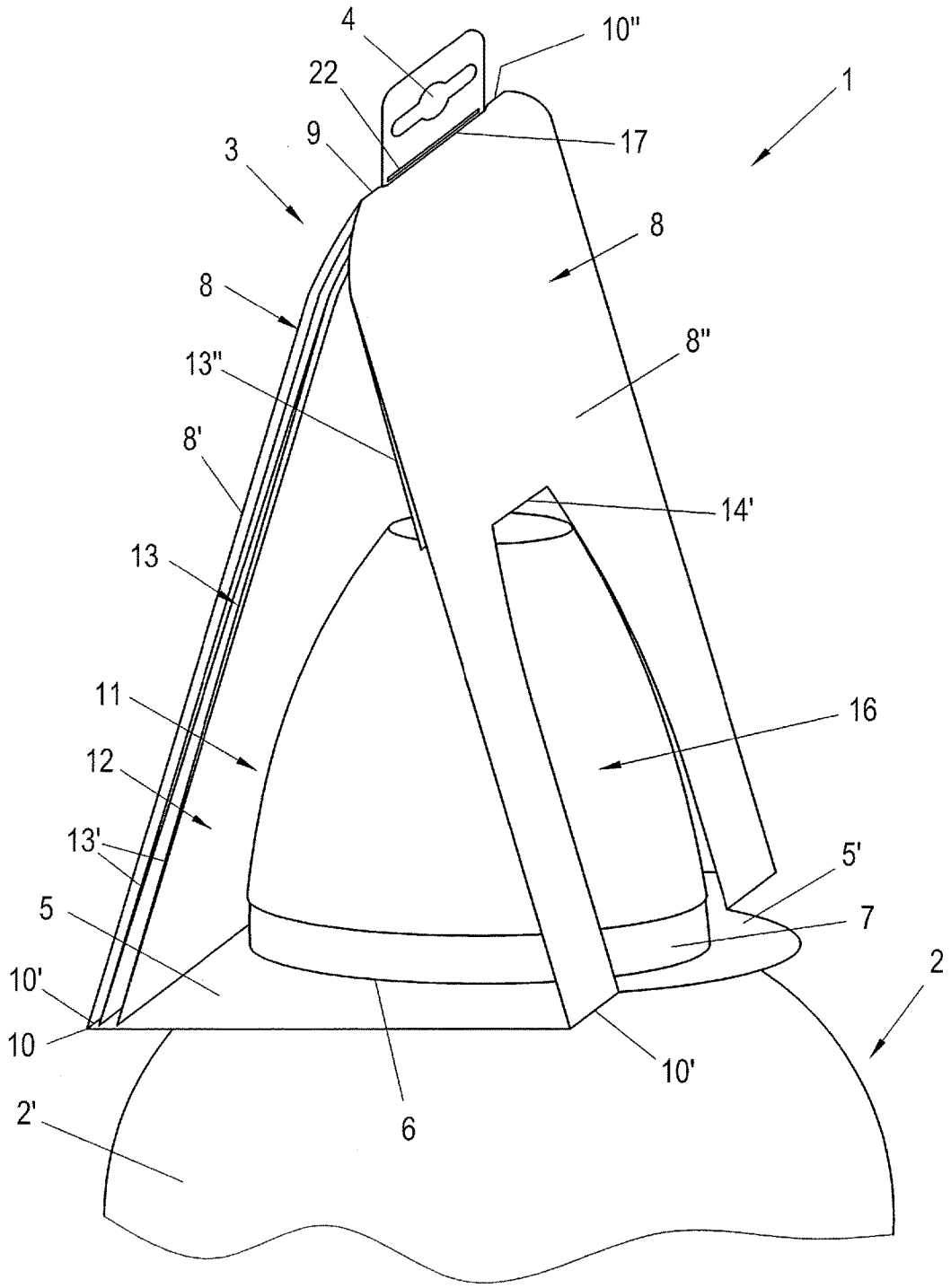
FIG. 2 shows a view of the suspension apparatus shown in FIG. 1 with the drinks bottle suspended thereon viewed in the direction of a tunnel-shaped recess for receiving the drinks bottle.
Figure 3:
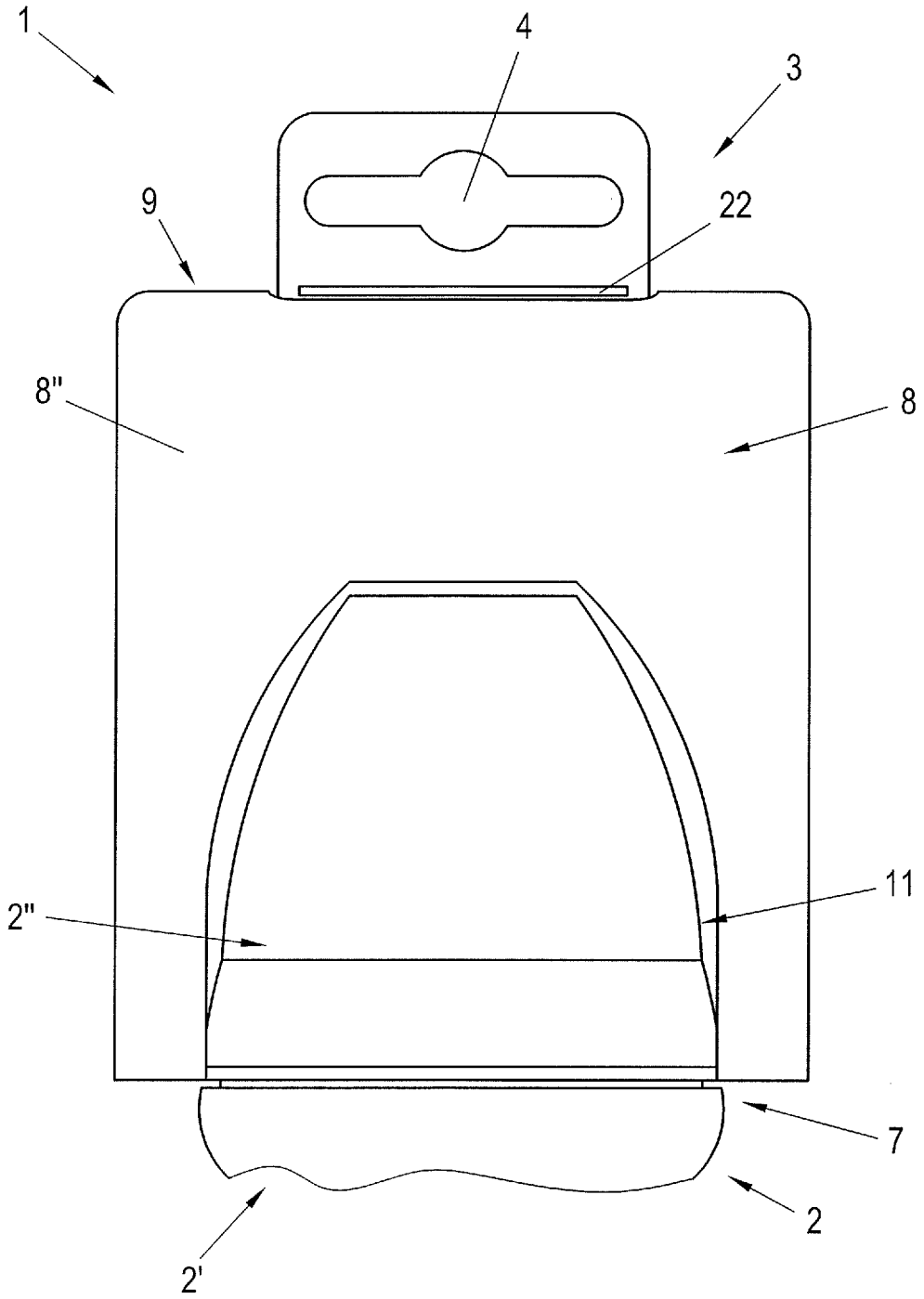
FIG. 3 shows a view of the suspension apparatus shown in FIGS. 1 and 2 with the drinks bottle suspended thereon, where a first side portion with a pivotable tab portion can be seen.
Figure 4:
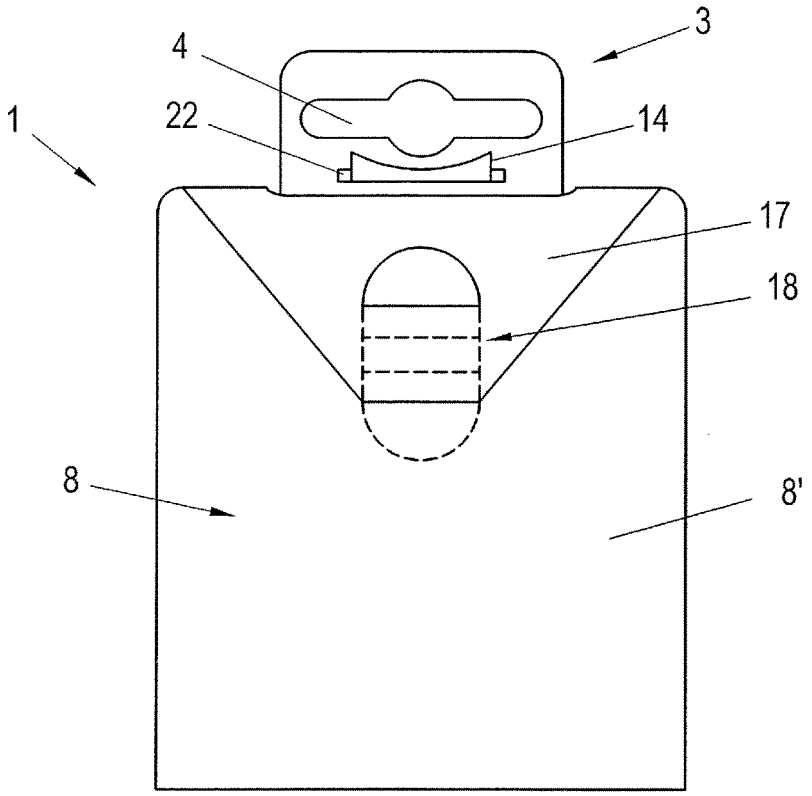
FIG. 4 shows a view of the suspension apparatus shown in FIGS. 1 to 3, from which a fastening tab held detachably on a second side portion can be seen.

FIGS. 1 to 5 show a suspension apparatus 1 for a sales item 2 which in the embodiment shown is used to suspend a drinks bottle 2'. For this purpose the suspension apparatus 1 has a hanging part 3 in which a suspension opening 4 is formed. The suspension apparatus 1 can be pushed by means of the suspension opening 4 onto a rod of a sales stand (not shown) and removed from there again.

As can be further seen from FIGS. 1 to 5, the suspension apparatus 1 has a substantially horizontally disposed base portion 5 when the suspension apparatus 1 is in use, in which a retaining opening 6 for carrying the sales item 2 is formed. In the embodiment shown, a bottle neck 7 or a covering cap of the drinks bottle 2' is gripped from behind by a section of the base portion 6 delimiting the retaining opening 6 so that the drinks bottle 2' is held positively on the retaining opening 6. The retaining opening 6 is configured to be circular to receive the bottle neck 7.

Figure 5:
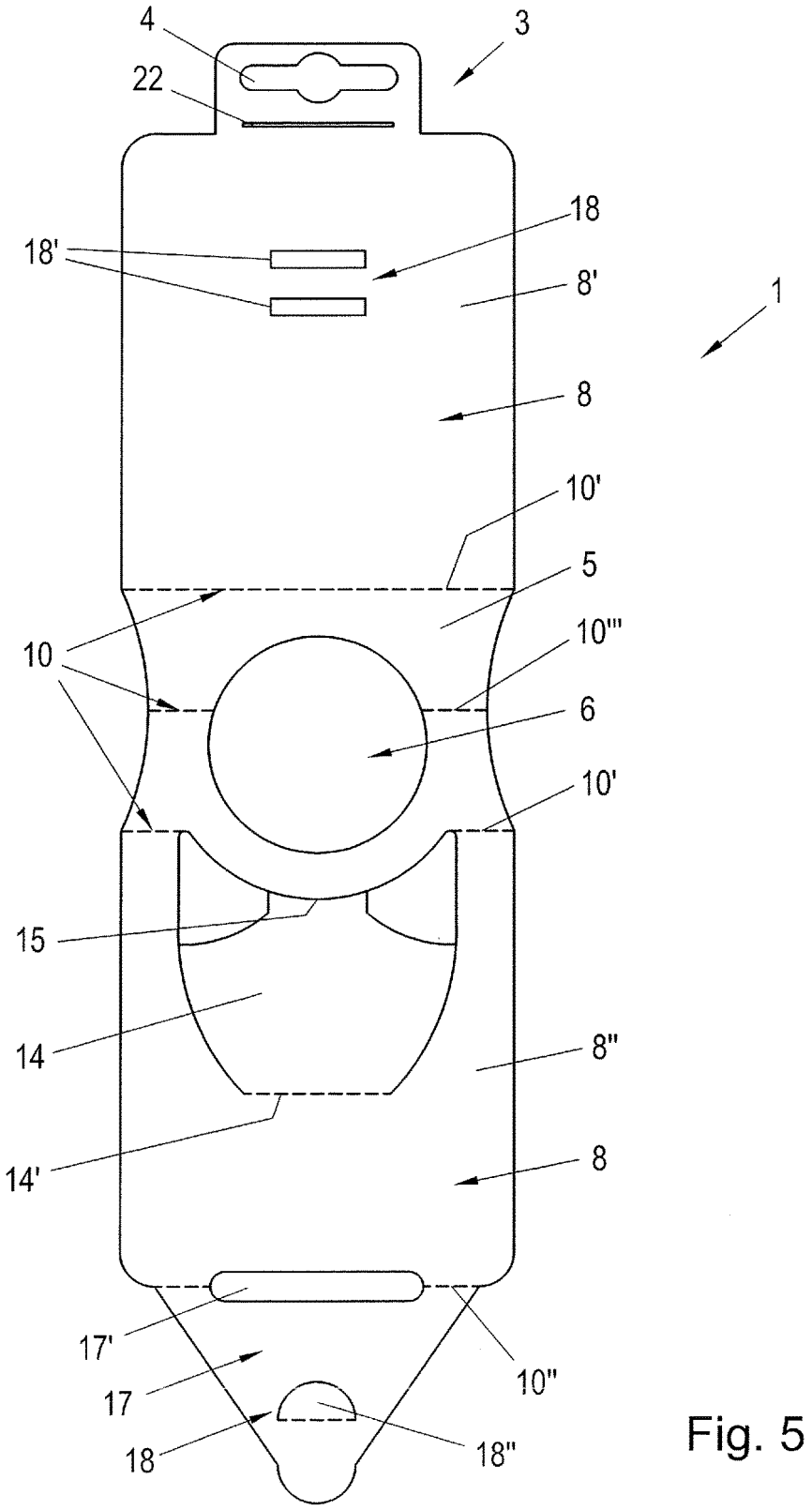
FIG. 5 shows a view of the suspension apparatus according to FIGS. 1 to 4 in the unfolded state.

As can be further seen from FIGS. 1 to 5, the suspension apparatus 1 further comprises two side portions 8 which are inclined with respect to one another starting from an abutting edge 9 formed between contacting edges of the side portions 8. The base portion 5 and the side portions 8 are in this case formed by a one-piece blank made of a plastic material, preferably polypropylene. To form the side portions 8 and the base portion 5 the blank is folded along fold lines 10 which comprise opposite longitudinal edges 10' of the base portion 6. FIGS. 1 to 4 show the suspension apparatus 1 in the folded state and FIG. 5 shows it in the unfolded state.

As can be further seen from FIGS. 1 to 5, the suspension apparatus 1 further has a fastening tab 17 which is bent about a fold line 10" along the abutting edge 9. The fastening tab 17 has a slot 17' (cf. FIG. 5) through which the hanging part 3 is guided. The fastening tab 17 is fastened to a side portion 8' by means of engaging means 18. The engaging means 18 comprise two fastening openings 18' on the side portion 8' which in the connected state (cf. FIG. 4) are gripped from behind by a tongue 18" which can be pivoted from the principal plane of the fastening tab 17 and the free end region of the fastening tab 17. Thus, the fastening tab 17 is detachably fastened to the side portion 8' at two connection points.

As can be further seen from FIGS. 1 to 5, the side portions 8 and the base portion 6 are arranged in the form of an isosceles triangle when viewed perpendicular to their principal plane, whose legs are formed by the side portions 8 and whose base is formed by the base portion 5. As a result of using a flexible plastic film for the blank, the suspension apparatus 1 can however be deformed in many different ways in use.

As can be further seen from FIGS. 1 to 5, a recess 11 is delimited between the side portions 8 and the base portion 5, into which the drinks bottle 2' fixed in the retaining opening 6 projects. In the embodiment shown the recess 11 has openings 12 on both front sides of the suspension apparatus 1, which extend over the entire height of the side portions 8 and over the entire width of the base portion 5.

As can be further seen from FIGS. 1 to 5, an insert 13 for displaying product or sales information is disposed loosely in the recess 11 so that in particular inserts in different languages can be inserted simply or the insert 13 can be exchanged as required. In the embodiment shown a folded sheet of a paper material comprising several sheets printed with the product or sales information (cf. FIG. 6) is provided as the insert 13. The insert 13 can be pushed via one of the openings 12 into the recess 11 of the suspension apparatus 1.

As can be further seen from FIGS. 1 to 5, the insert 13 in contact with the inner side of a side portion 8' extends over the entire height and over the entire width of the side portion 8'. A frictional engagement between the insert 13 and the side portion 8' can herewith be achieved which counteracts any slippage of the insert 13. The outer edge of the insert 13 extends in this case along the abutting edge 9 between the side portions 8, whereby the outer edge of the insert 13 is guided or held between the side portions 8. In the embodiment shown the insert 13 is additionally fixed between the part of the sales item 2 projecting through the retaining opening 6 into the recess 11 and the side portion 8'.

As can be further seen from FIGS. 1 to 5, a tab portion 14 is provided on a side portion 8" which is cut free from the side portion 8" by a cutting edge 15. The tab portion 14 is pivotable about a pivot axis 14' running in the principal plane of the side portion 8. In the pivoted position a recess 16 is exposed on the side portion 8 through which a closure cap 2" of the drinks bottle 2' passes. The cutting edge 15 additionally creates a semicircular extension 5' of the base portion 5 going beyond a longitudinal edge 10' of the base portion 5 in the embodiment shown, into which the retaining opening 6 extends.

As can be further seen from FIGS. 1 to 5, the insert 13 is additionally held positively on the suspension apparatus 1. For this purpose the tab portion 14 is additionally formed as a fastener part 21 which is guided in the pivoted position through a fastener opening 20 of the insert 13 which can be seen in FIG. 6. The free end region of the tab portion 14 is fixed in a receiving opening 22, thus preventing the tab portion 14 from sliding unintentionally from the fastener opening 20 of the insert 13. In the embodiment shown the fastener opening 20 of the insert 13 is formed on the hanging part 3 between the suspension opening 4 and the upper edge of the side portion 8'.

In addition, a fold line 10'" can be seen from FIG. 5 which extends centrally between the longitudinal edges 10' of the base portion 5. A flat arrangement of the suspension apparatus 1 in the folded state is made possible by this means.

Figure 6:
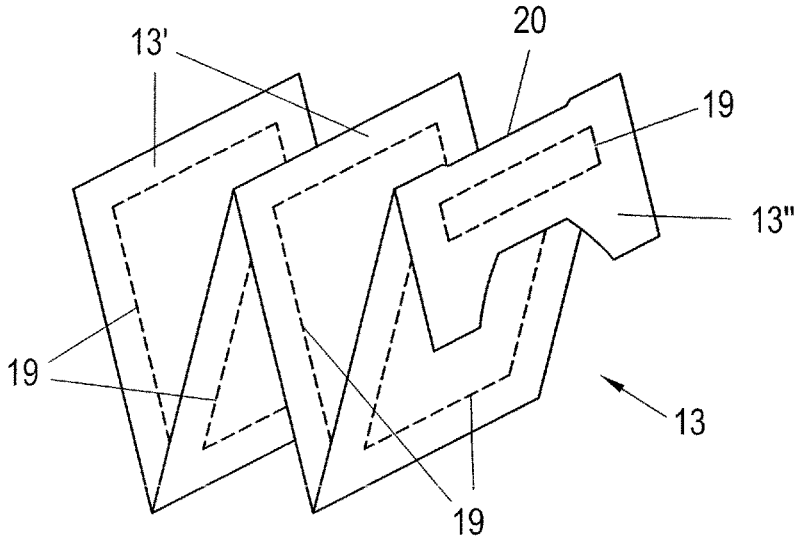
FIG. 6 shows a view of the insert to display the product or sales information.

The insert 13 can be seen in FIG. 6 which, in the embodiment shown is configured as a folded sheet comprising a plurality of sheets 13' connected along edge-side fold lines. In addition, an end section 13" is provided which in the usage position of the suspension apparatus rests against the side portion 8". The end section 13" is shaped according to the contour of the tab portion 14. The sheets 13' or the end section 13" of the folded sheet in this case have fields 19 (shown schematically in FIG. 6) printed with the product or sales information.

As can be further seen from FIG. 6, the fastener opening 20 of the insertion part 13 which can be connected to the tab portion 14 extends along the fold line between the end section 13" and the adjacent sheet 13' of the insert 13.

The invention claimed is:

1. A suspension apparatus for a sales item product comprising:

a base portion which has a retaining opening for carrying the sales item and;

comprising side portions which with the base portion enclose a first recess for receiving a portion of the sales product projecting through the retaining opening;

wherein the side portions are arranged inclined with respect to one another starting from an abutting edge, at least one of the side portions comprising a hanging part having a suspension opening for suspending the suspension apparatus;

wherein a sheet printed with the product or sales information is provided as an insert for displaying product or sales information, wherein said insert is held exchangeably in the first recess enclosed by the side portions and the base portion, said sheet extends over an entire height of the first recess enclosed by the sided portions between the abutting edge and the base portion and rests at least in sections against the abutting edge between the side portions such that an outer edge of the insert is guided between the side portions enclosing said first recess in which the insert is exchangeably disposed.

2. The suspension apparatus according to claim 1 wherein the insert rests at least in sections against an inner side of one of the side portions.

3. The suspension apparatus according to claim 1 wherein the base portion and the side portions are formed by a preferably one-part blank of a foldable material which is folded along fold lines.

4. The suspension apparatus according to claim 3, wherein said foldable material is a plastic film.

5. The suspension apparatus of claim 4, wherein the plastic film is made of polypropylene.

6. The suspension apparatus according to claim 1 wherein the insert has a fastener opening for passage of a fastener portion.

7. The suspension apparatus according to claim 6, wherein the fastener opening of the insert runs along a fold line of the insert.

8. The suspension apparatus according to claim 6 wherein a receiving opening is provided for an end region of the fastener portion guided through the fastener opening of the insert.

9. The suspension apparatus according to claim 1 wherein a tab portion which can be pivoted from a principal plane of the side portion is provided on one of the side portions.

10. The suspension apparatus according to claim 9, wherein a second recess for exposing the portion of the sales item projecting through the retaining opening is formed on the side portion in a pivoted position of the tab portion.

11. The suspension apparatus according to claim 9, wherein the tab portion is configured as a fastener portion for connection to the fastener opening.

12. The suspension apparatus according to claim 9 wherein the tab portion is formed by a cut edge from the side portion.

13. The suspension apparatus according to claim 1 wherein the retaining opening for holding a bottle neck of a drinking bottle is substantially circular.

14. The suspension apparatus of claim 1 wherein the sales item is for a drinks bottle.

15. The suspension apparatus of claim 1, wherein said sheet is a folded sheet.

16. The suspension apparatus of claim 15 wherein said folded sheet is made of a paper material.

* * * * *